US005687511A

United States Patent [19]

Dal Lago

[11] Patent Number: 5,687,511

[45] Date of Patent: Nov. 18, 1997

[54] PREFABRICATED TILE WITH A PLURALITY OF LIGHT DIFFUSION SITES FOR REALIZING BUILDING ROOFINGS

[75] Inventor: Alberto Dal Lago, Milan, Italy

[73] Assignee: DLC S.r.l., Milan, Italy

[21] Appl. No.: 551,430

[22] Filed: Nov. 1, 1995

[51] Int. Cl.[6] ..... E04B 7/12

[52] U.S. Cl. ..... 52/18; 52/22; 52/90.1; 52/602

[58] Field of Search ..... 52/200, 173.3, 52/90.1, 602, 91.1, 13, 18, 22

[56] References Cited

U.S. PATENT DOCUMENTS

| | | | |
|---|---|---|---|
| 1,289,188 | 12/1918 | Keppler | 52/200 |
| 2,253,527 | 8/1941 | Ohlis | 52/200 |
| 3,967,423 | 7/1976 | Hammond | 52/200 |
| 5,118,543 | 6/1992 | McColl | 52/200 |

*Primary Examiner*—Michael Safavi

*Attorney, Agent, or Firm*—Hedman, Gibson & Costigan, P.C.

[57] ABSTRACT

A prefabricated tile for covering building roofings comprises a plurality of side-by-side light diffusion sites (13) defined by openings (15) provided through a lower flat slab (11) of said tile. From said lower flat slab (11) mutually opposite side walls (12) extend upwards with decreasing height from the middle to the ends of said tile, wherein through said side walls (12) openings (14) are provided to make the whole structure lighter and allow service equipment to run through.

4 Claims, 7 Drawing Sheets

PREFABRICATED TILE WITH A PLURALITY OF LIGHT DIFFUSION SITES FOR REALIZING BUILDING ROOFINGS

The present invention relates to a prefabricated tile designed for producing building roofings. The tile displays the feature of being provided with a plurality of light diffusion sites arranged according to a particularly advantageous fashion.

Those skilled in the art appreciate that one of the technical problems to be solved when building roofings are made by using prefabricated tiles, is how to provide a lighting system, for both day- and night-time, which is as satisfactory as possible from both viewpoints of cheapness and quality of results.

Another technical problem to be solved is how to provide a tile which is as light-weight as possible, while however displaying all required characteristics in terms of mechanical strength.

Therefore, the general purpose of the invention is to solve the above said technical problems in a way which is as functional and advantageous as possible, by providing a tile which, besides being provided with a plurality of sites of (either day light or indoor light) light diffusion, simultaneously has a very light-weight structure.

The above purpose is achieved according to the invention by providing a prefabricated tile for building roofing which is characterized in that said tile comprises a plurality of light diffusion sites (13) arranged side-to-side. The light diffusion sites comprise openings provided through a lower flat slab (11) of said tile.

According to a preferred embodiment of the present invention, the tile has mutually opposite side walls (12) extend upwardly with decreasing height from the middle to the ends of said tile. The side walls (12) have opening (14) which are provided to reduce the weight of the structure and to allow service equipment to be passed through the tiles.

The invention and its advantages over the prior art will be particularly clear from a study of the following disclosure, made by referring to the accompanying schematic drawings, in which.

Figure 1:
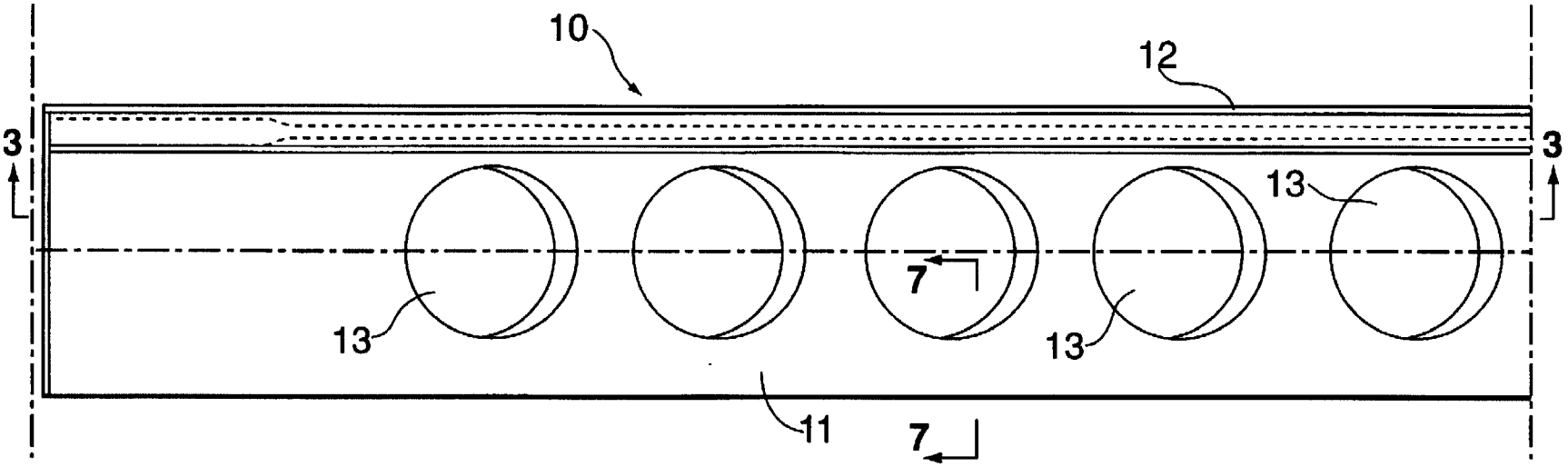
FIG. 1 shows a partially cutaway top plan view illustrating the tile according to the present invention. The tile is transversely cut at its middle for the sake of simplifying the drawing with the other half thereof being the mirror image of the illustrated half-tile.
Figure 2:
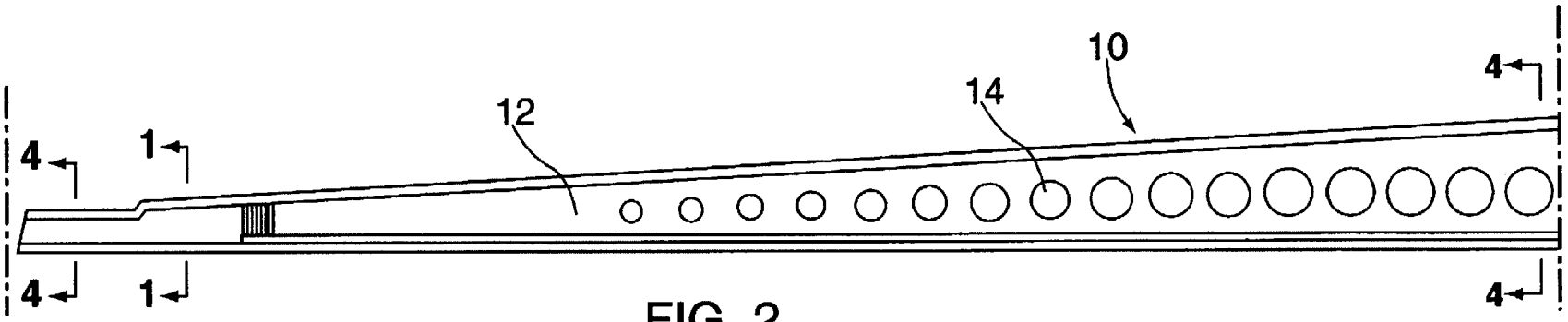
FIG. 2 shows a side elevation view of the tile of FIG. 1.
Figure 3:
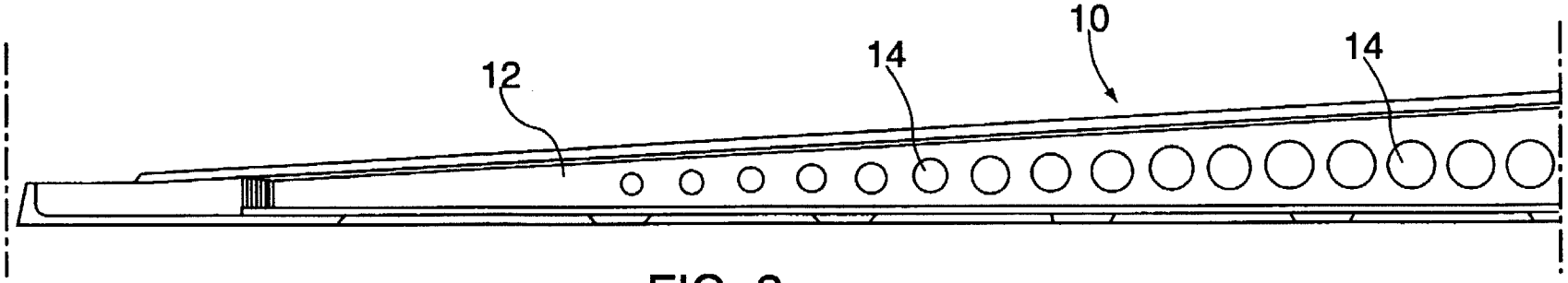
FIG. 3 shows a sectional view made according to the section line III—III of FIG. 1.
Figures 4, 5:
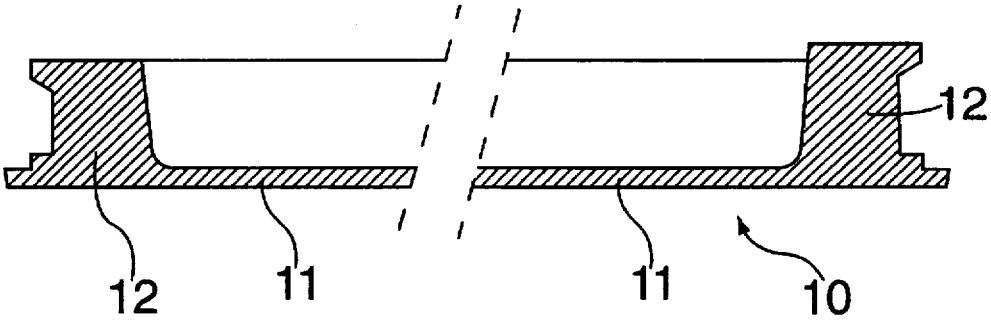
FIG. 4 shows a sectional view made according to the section line IV—IV of FIG. 2.
FIG. 5 shows a sectional view made according to the section line V—V of FIG. 2.
Figure 6:
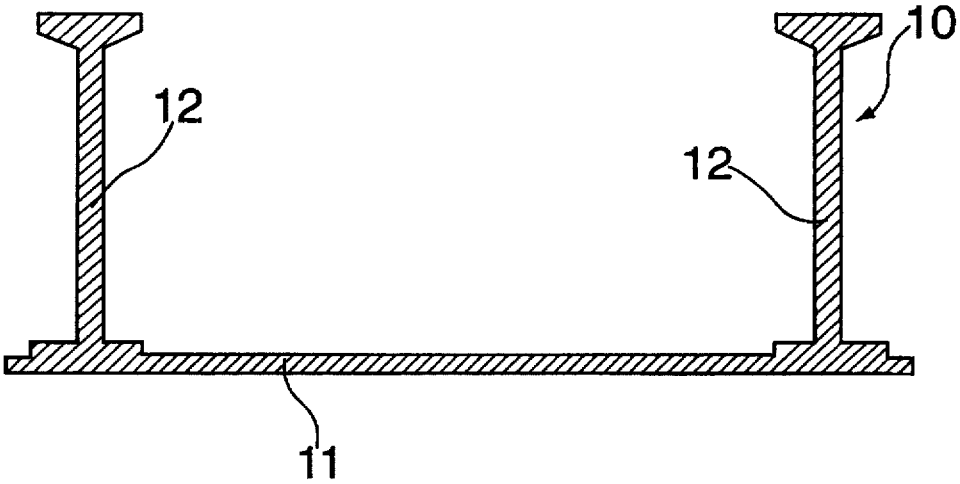
FIG. 6 shows a sectional view made according to the section line VI—VI of FIG. 2.

Referring to the drawings, the tile according to the present invention is generally indicated with the numeral (10) and is structurally formed by a bottom flat slab (11) from which mutually opposite vertical walls (12) extend upwards with decreasing height from the middle to the ends (FIGS. 2–6).

According to the present invention, the slab (11) is provided with a plurality of side-by-side light diffusion sites (13), and the mutually opposite side walls (12) are provided with openings (14) for reducing the weight of the tile and allowing service equipment to be run through.

Said light diffusion sites (13) can be used for allowing day light to penetrate the interior of the building, without the aid of any electrical apparatus, and also for night lighting by means of electrical light sources installed inside the interior of the tile, in such a way that indoor lighting simulates day light lighting.

Figure 7:
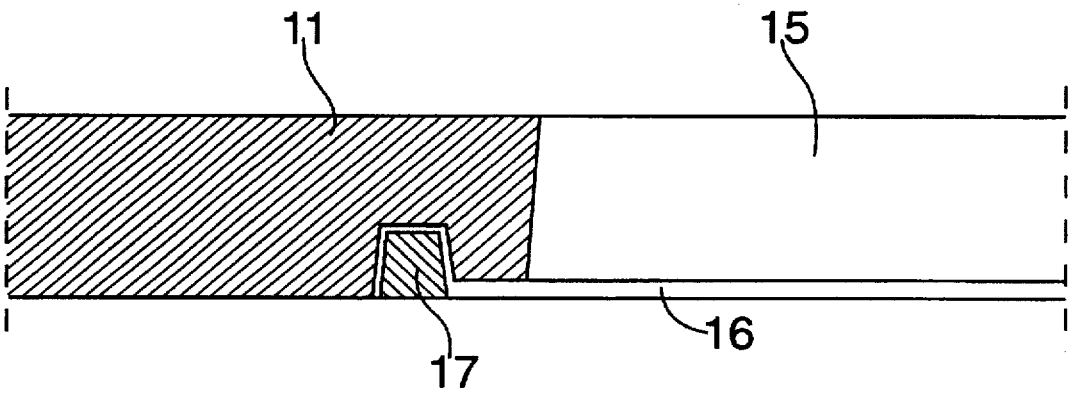
FIG. 7 shows a sectional view on an enlarged scale, made according to the section line VII—VII of FIG. 1.
Figure 8:
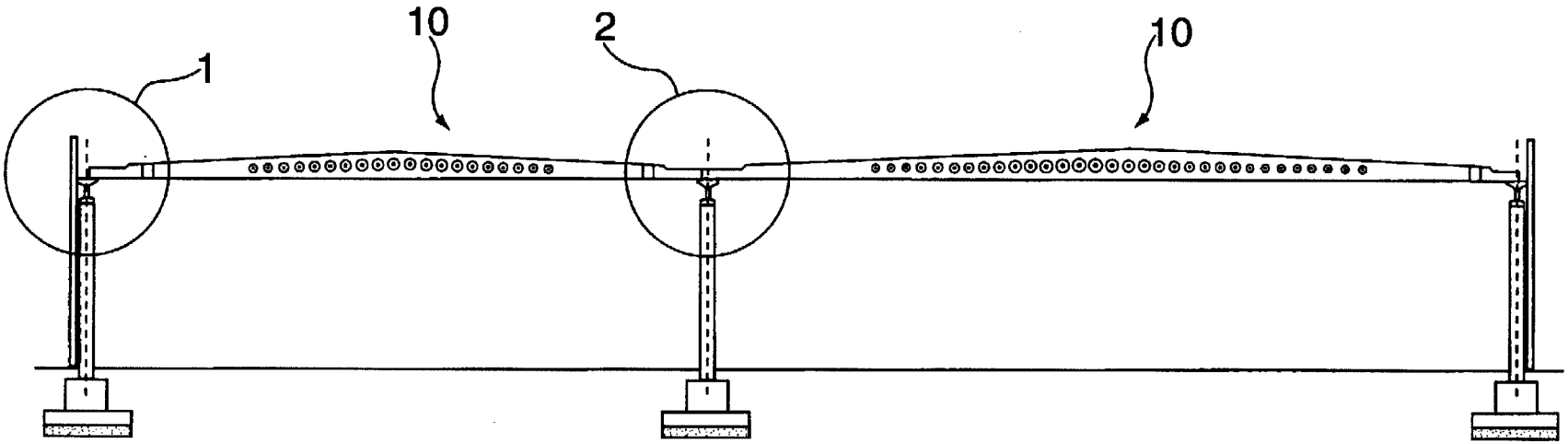
FIG. 8 shows a vertical sectional view illustrating a building, the roofing of which is made by using tiles according to be the present invention, with said sectional view being made according to the section line VIII—VIII of FIG. 9.
Figure 9:
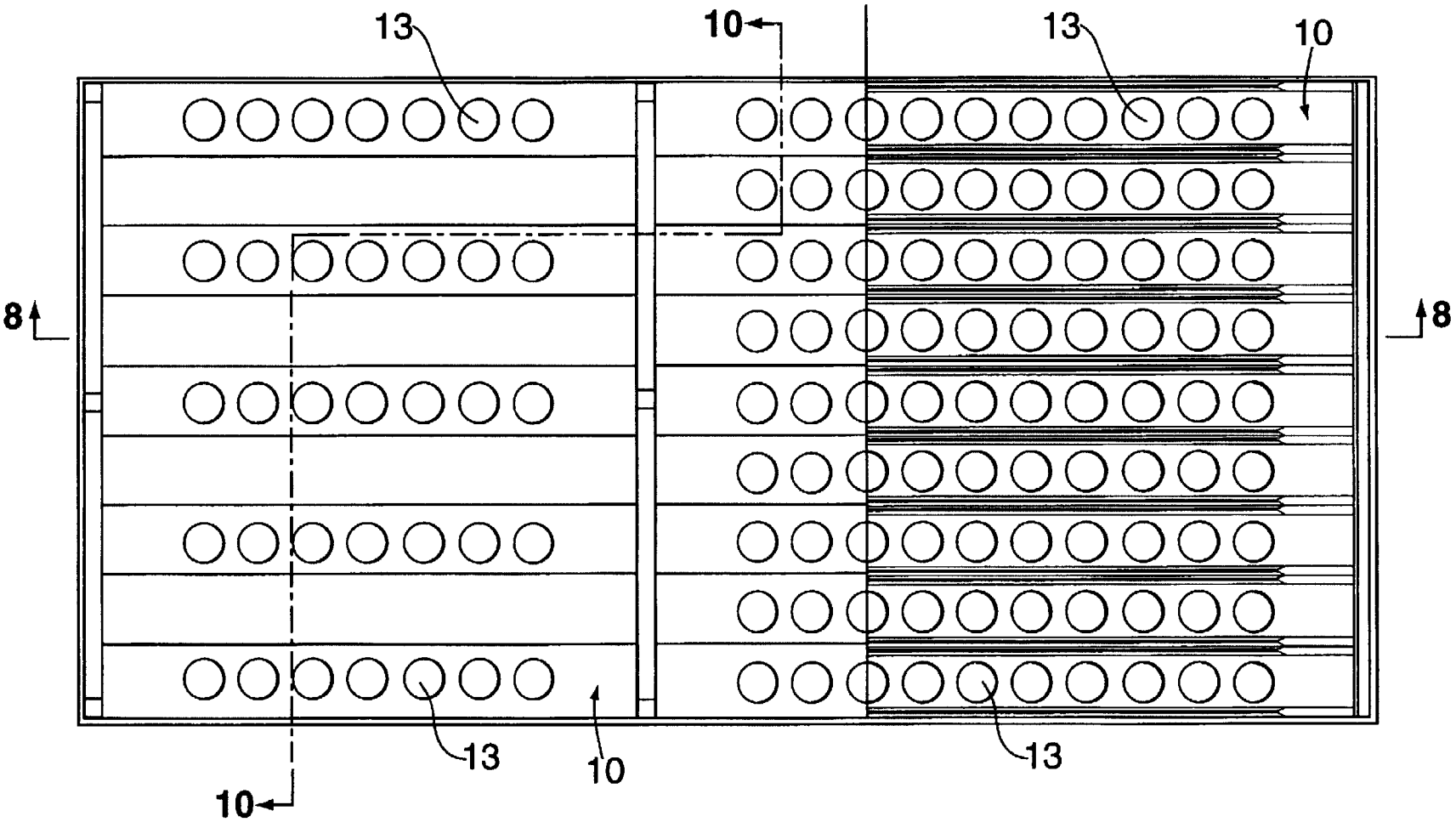
FIG. 9 shows a plan view of the building of FIG. 8, in which the roofing of the right-hand bay, looking at the drawing, is seen from above, and the roofing of the left-hand bay is seen from underneath.
Figure 10:
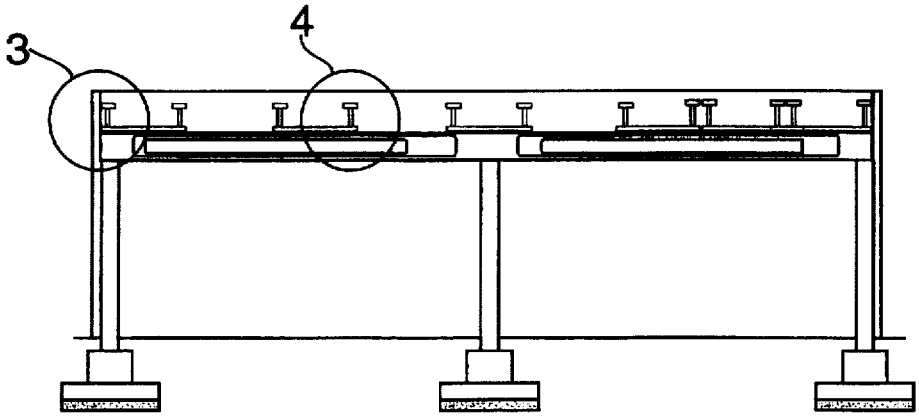
FIG. 10 shows a sectional view made according to the section line X—X of FIG. 9.
Figure 12:
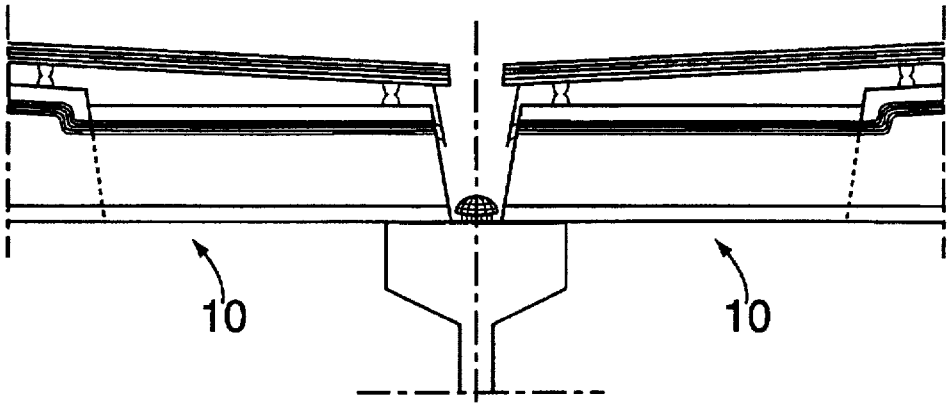
FIG. 12 shows an enlarged detail of zone 2 of FIG. 8.
Figure 15:
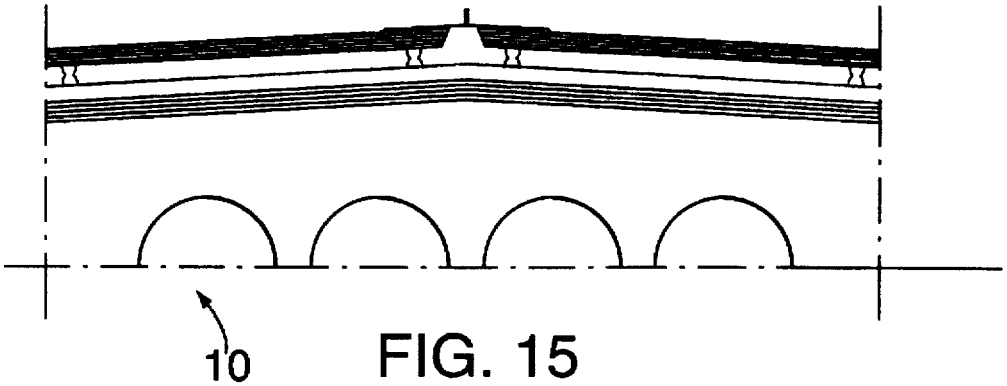
FIG. 15 shows an enlarged detail of the ridge zone of the tile.
Figure 11:
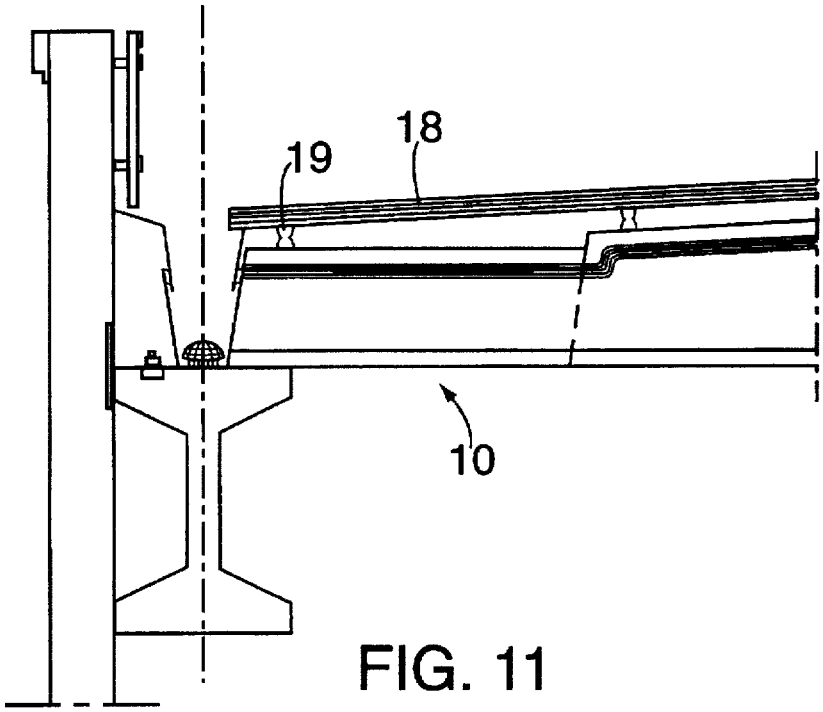
FIG. 11 shows an enlarged detail of zone 1 of FIG. 8.
Figure 13:
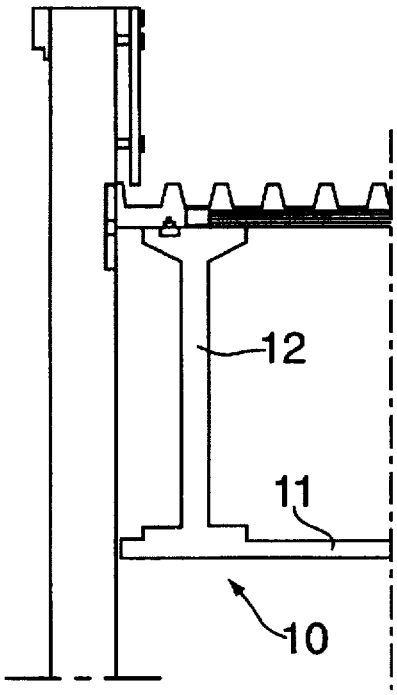
FIG. 13 shows an enlarged detail of zone 3 of FIG. 10.
Figure 14:
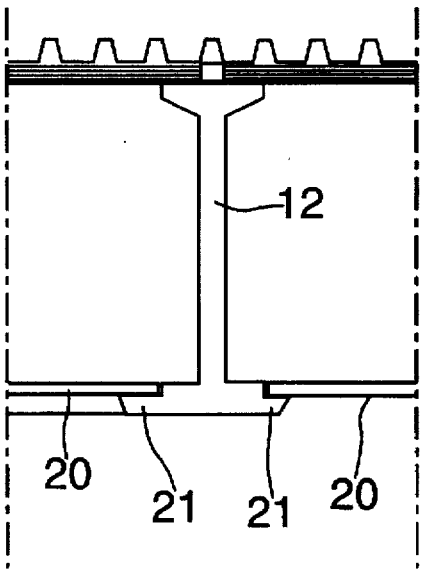
FIG. 14 shows an enlarged detail of zone 4 of FIG. 10.

As one will clearly see from FIG. 7 of accompanying drawings, the light diffusion sites (13) are defined by openings (15), which can be given a circular shape, as well as any other shape, and are closed with a transparent diffuser (16) provided with a peripheral gasket (17).

FIGS. 8–14 illustrate an exemplary building the roofing of which is made by using a plurality of tiles according to the present invention, installed side-by-side.

As one will clearly see from the drawings, the tiles (10) can be sealed by means of water-proofing elements (18) fastened to purlines (19) transversely extending relatively to the tiles (10). Those portions of said elements (18) which are opposite to the light diffusion sites (13) are translucent.

The space between the mutually spaced apart tiles can be closed, e.g., by means of polycarbonate panels (20) resting on teeth (21) outwards extending from the foot of the side walls (12) of each tile.

In that way, a prefabricated tile for building roofings is provided which has a very light-weight structure and is provided with a lighting system by day light diffusion, as well as by indoor light diffusion.

Additionally to the above, the tile according to the present invention makes possible the construction of a flat ceiling having an upper hollow space for insulation purposes.

I claim:

1. Prefabricated tile for building roofing which comprise a plurality of light diffusion sites (13) which are arranged side-to-side, said light diffusion sites (13) comprising openings (15) which extend through a lower flat slab (11) of said tile wherein said lower flat slab (11) has mutually opposite side walls (12) which extend upwardly with decreasing height from the middle to the ends of said tile and having through said side walls (12) openings (14) which are provided to make the whole structure lighter and allow service equipment to be run through.

2. Tile according to claim 1, wherein said openings (15) are circular openings.

3. Tile according to claim 1 wherein at said light diffusion sites (13) there are provided top closures made of translucent waterproofing elements (18) which extend between said side walls (12).

4. Tile according to claim 1 wherein said tile is provided with a bottom closure consisting of a false ceiling made of panels (20) resting on teeth (21) which extend outwardly from the foot of said walls (12).

* * * * *